United States Patent [19]

Andersson et al.

[11] Patent Number: 4,645,014

[45] Date of Patent: Feb. 24, 1987

[54] AMPLITUDE CHANGING APPARATUS

[75] Inventors: Uno Andersson, Gnesta; Bengt Svensson, Hässlö, both of Sweden

[73] Assignee: Dynapac AB, Solna, Sweden

[21] Appl. No.: 670,824

[22] Filed: Nov. 13, 1984

[30] Foreign Application Priority Data

Nov. 11, 1983 [SE] Sweden ..... 8306217

[51] Int. Cl.[4] ..... B06B 1/16

[52] U.S. Cl. ..... 173/49; 318/284

[58] Field of Search ..... 173/49; 74/87; 318/284, 318/285

[56] References Cited

U.S. PATENT DOCUMENTS

| | | | |
|---|---|---|---|
| 3,566,228 | 2/1971 | Tsergas | 318/284 |
| 4,168,774 | 9/1979 | Musschoot | 74/87 |
| 4,452,016 | 6/1984 | Majors | 74/87 |

OTHER PUBLICATIONS

IBM Technical Disclosure Bulletin, vol. 19, No. 5, Oct. 1976.

*Primary Examiner*—Donald R. Schran
*Assistant Examiner*—James L. Wolfe
*Attorney, Agent, or Firm*—Walter Ottesen

[57] ABSTRACT

The invention is directed to an apparatus for resetting the vibration amplitude of a hydraulically driven vibration device having two eccentric weights arranged on a rotating shaft and rotatable relative to each other. The amplitude-resetting arrangement includes a hydraulic directional valve for resetting the vibration device between high and low amplitudes. The valve is electrically operated and the electric control circuit incorporates a time-delay relay for delaying the amplitude change until the speed of the rotating shaft has been reduced to an acceptable level.

2 Claims, 1 Drawing Figure

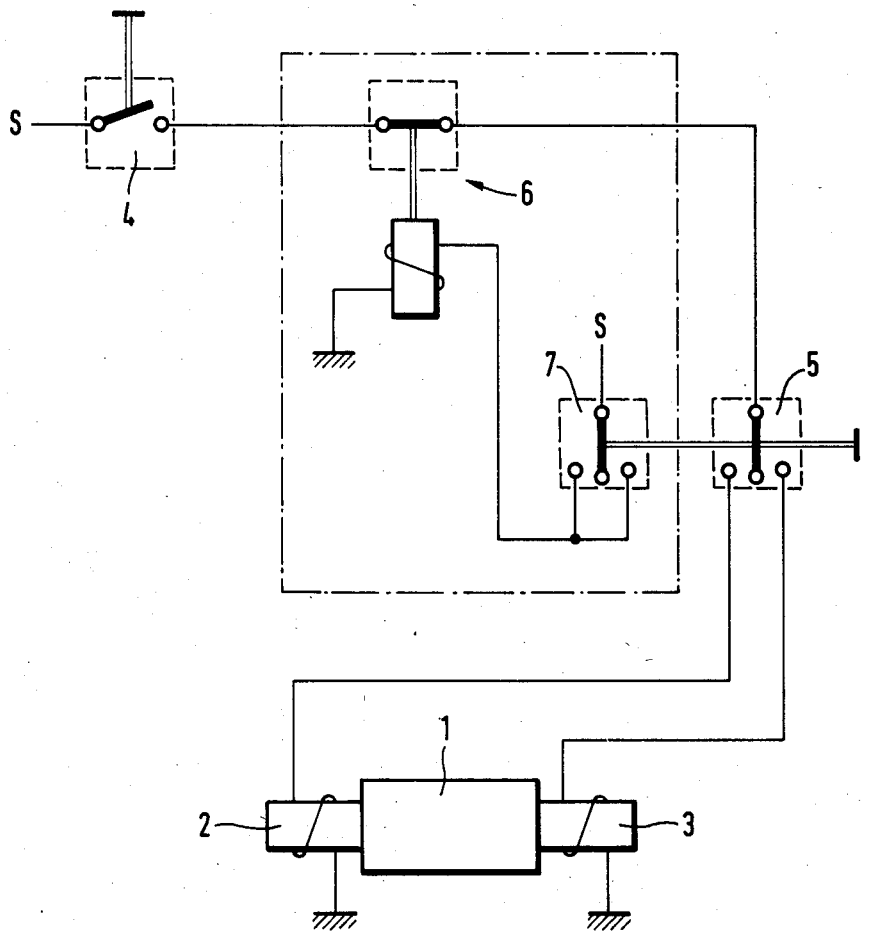
S
4
6
S
7
5
1
2
3

AMPLITUDE CHANGING APPARATUS

FIELD OF THE INVENTION

The invention relates to a vibration device including two eccentric weights arranged on a rotating shaft which are rotatable relative to each other. This type of vibration device is often used on vibratory rollers for compacting soil, asphalt and the like. The invention relates in particular to a regulating device for changing the position of these eccentric weights relative to each other from high to low amplitude and vice versa.

BACKGROUND OF THE INVENTION

Vibration devices of this type are generally designed in such a way that one of the eccentrics is fixed and the other is capable of movement relative to the rotating shaft. The vibration amplitude is reset by changing the direction of rotation of the shaft. The disadvantage of these known amplitude-changing devices is that breakdowns frequently occur in the rotating shaft and its bearings, as well as in the hydraulic drive system, because of the vibration arising if the change from high to low amplitude and vice versa is carried out too rapidly.

In the case of instantaneous amplitude changes, all the kinetic energy of the rotating shaft is absorbed in an extremely short time. As mentioned above, this gives rise to high mechanical stresses in the rotating shaft and also sudden pressure surges in the hydraulic system. Instantaneous amplitude changes also give rise to heavy impacts when the movable eccentric strikes the fixed eccentric mounted rigidly on the eccentric shaft. Attempts have been made to avoid this by covering the contact surfaces of the respective eccentrics with shock-absorbing material such as rubber pads. However, such rubber pads disintegrate rapidly and have a comparatively short service life.

SUMMARY OF THE INVENTION

It is an object of the invention to avoid the above-mentioned disadvantages by providing an amplitude changing apparatus incorporating an electrically-controlled directional valve.

The amplitude changing apparatus of the invention includes time-delay relay means in the circuit supplying the directional valve. By delaying the electric signal transmitted to the directional valve, the eccentric shaft is given time to reduce its kinetic energy to the desired level before the amplitude change takes place. The reduction of kinetic energy results in a substantially "softer" impact when the eccentrics slam into each other thereby producing appreciably less noise and providing a longer service life for the eccentric element.

BRIEF DESCRIPTION OF THE DRAWING

The invention will be described in more detail in the following with reference to the appended drawing which shows a schematic of the amplitude changing apparatus according to the invention.

DESCRIPTION OF THE PREFERRED EMBODIMENTS OF THE INVENTION

Incorporated in the hydraulic drive circuit for the eccentric shaft of the vibration device is a directional valve 1 the purpose of which is to change the rotational direction of the shaft. The valve is controlled by two solenoids 2 and 3 connected to an electric time-delay circuit incorporating a switch 4 for turning the hydraulic drive circuit on and off. As a rule, switch 4 is located in the forward-reverse control of the compaction machine in which the vibration device is mounted. The electric circuit contains an additional switch 5 for actuating solenoids 2 and 3, that is, for selecting the rotational direction of the eccentric shaft with high and low vibration amplitude, respectively.

On rapid actuation of switch 5 from low to high amplitude or vice versa, severe pressure shocks arise in the hydraulic system. The danger of damage to the hydraulic system as a result of these pressure shocks can be prevented, or at least reduced, by delaying the amplitude-changing operation.

Such a delay is obtained according to a feature of the invention by incorporating a time-delay relay 6 in the electric circuit in combination with a switch 7 connected mechanically to switch 5 for engaging high and low amplitudes, respectively.

Operation of the forward-reverse control of the roller causes switch 4 to close and so energize time-delay relay 6, which is normally closed. As a result, either solenoid 2 or solenoid 3 is actuated, depending on the amplitude for which switch 5 is set, and the amplitude selected with this switch is then engaged. On resetting the amplitude by means of switch 5, switch 7 is simultaneously closed and connects time-delay relay 6 to power supply S. Time-delay relay 6 then receives a signal and breaks its connection with switch 5 for a predetermined length of time, following which switch 5 again receives current from power supply S and actuates whichever one of the solenoids 2 or 3 is connected by the switch thereby causing engagement of the selected amplitude.

Rapid engagement and disengagement of the selected vibration amplitude can be carried out by means of switch 4 without a time delay.

Time-delay relay 6 comes into operation as soon as a change of amplitude is signalled by actuation of switch 5.

Since the amplitude change is delayed, there is time for the rotational speed of the eccentric shaft to slow down by a sufficient amount to avoid damage to the latter and the hydraulic system.

It is understood that the foregoing description is that of the preferred embodiments of the invention and that various changes and modifications may be made thereto without departing from the spirit and scope of the invention as defined in the appended claims.

What is claimed is:

1. An apparatus for changing the amplitude of vibration of a hydraulically-driven vibration device that includes two eccentrics arranged on a rotary shaft, one of the eccentrics being fixed to the shaft and the other one of the eccentrics being rotatable relative to the shaft, the apparatus comprising:

hydraulic valve means including directional valve means for changing the direction of rotation of the rotary shaft from a first direction of rotation corresponding to a high amplitude of vibration to a second direction of rotation corresponding to a low amplitude of vibration;

said hydraulic valve means further including two solenoids for actuating said directional valve means, said solenoids corresponding to respective ones of said amplitudes of vibration;

power supply means supplying electrical energy to actuate said solenoids;

an electric circuit for connecting said power supply means to said solenoids, the electric circuit including:

first switch means for connecting said power supply means to said circuit;

second switch means movable from a first position whereat one of said solenoids is connected to said first switch means to a second position whereat the other one of said solenoids is connected to said first switch means;

normally-closed time-delay relay means for opening its contact for a predetermined period of time, said contact being disposed in said electric circuit between said power supply means and said solenoids; and, third switch means mechanically connected to said second switch means for actuating said relay means only in response to a movement of said second switch means between said first and second positions thereof thereby causing said contact to prevent the flow of current to the one of said solenoids connected to said first switch means by said second switch means for said predetermined period of time so as to delay the change in the direction of said rotation thereby permitting a reduction in the kinetic energy of said shaft before said change of direction occurs.

2. An apparatus for changing the amplitude of vibration of a hydraulically-driven vibration device that includes two eccentrics arranged on a rotary shaft, one of the eccentrics being fixed to the shaft and the other one of the eccentrics being rotatable relative to the shaft, the apparatus comprising:

hydraulic valve means including directional valve means for changing the direction of rotation of the rotary shaft from a first direction of rotation corresponding to a high amplitude of vibration to a second direction of rotation corresponding to a low amplitude of vibration;

said hydraulic valve means further including two solenoids for actuating said directional valve means, said solenoids corresponding to respective ones of said amplitudes of vibration;

power supply means supplying electrical energy to actuate said solenoids;

an electric circuit for connecting said power supply means to said solenoids, the electric circuit including:

first switch means for connecting said power supply means to said circuit;

second switch means movable from a first position whereat one of said solenoids is connected to said first switch means to a second position whereat the other one of said solenoids is connected to said first switch means;

normally-closed time-delay relay means for opening its contact for a predetermined period of time, said relay means having coil means for actuating said contact and said contact being disposed in said electric circuit between said power supply means and said solenoids; and, third switch means movable between two positions whereat said power supply means is connected to said coil means of said relay means, said third switch being mechanically connected to said second switch means so as to be actuable simultaneously therewith causing said power supply means to be disconnected from said coil means during the switching action thereby causing said time-delay relay means to open said contact for said predetermined period of time whereafter said contact again closes thereby permitting current to flow to the one of said solenoids connected to said first switch means by said second switch means.

* * * * *